US005379525A

United States Patent [19]

Raynor

[11] Patent Number: 5,379,525

[45] Date of Patent: Jan. 10, 1995

[54] DRYING STAND FOR SKI BOOTS, GLOVES AND THE LIKE

[76] Inventor: George T. Raynor, P.O. Box 495, Westhampton Beach, N.Y. 11978

[21] Appl. No.: 234,682

[22] Filed: Apr. 28, 1994

[51] Int. Cl.[6] ..... F26B 25/00

[52] U.S. Cl. ..... 34/104; 34/90; 34/239

[58] Field of Search ..... 34/104, 105, 106, 90, 34/202, 239, 240

[56] References Cited

U.S. PATENT DOCUMENTS

| | | | |
|---|---|---|---|
| D. 243,313 | 2/1977 | Varnado | D7/196 |
| 2,614,337 | 10/1952 | Darbo | 34/104 |
| 4,094,076 | 6/1978 | Baslow | 34/90 |
| 4,136,464 | 1/1979 | Hay | 34/104 |
| 4,265,030 | 5/1981 | Smallegan | 34/104 |
| 5,003,707 | 4/1991 | Chu | 34/104 |
| 5,014,446 | 5/1991 | Reesman | 34/202 |
| 5,016,364 | 5/1991 | Cochrane | 34/195 |
| 5,115,580 | 5/1992 | Blumenfeld et al. | 34/104 |
| 5,179,790 | 1/1993 | Poulos | 34/104 |
| 5,249,369 | 10/1993 | Mallet | 34/104 |

*Primary Examiner*—Denise L. Gromada
*Attorney, Agent, or Firm*—Galgano & Burke

[57] ABSTRACT

A drying stand for ski boots, gloves and other clothing items, includes a generally planar, horizontally-disposed top wall having an opening formed therethrough dimensioned to accommodate a portable hair dryer nozzle. The top wall is supported such that it is spaced in a raised position relative to a ground support so as to enable one to position a clothing a clothing article beneath the opening in the top wall. A variable-adjustable aperture is mounted adjacent the opening through which the nozzle may extend and be generally supported in an upright manner. The aperture automatically adjusts to the diameter of the dryer nozzle to provide proper support therefor.

12 Claims, 2 Drawing Sheets

DRYING STAND FOR SKI BOOTS, GLOVES AND THE LIKE

BACKGROUND OF THE INVENTION

The present invention relates to a drying stand for clothing and, in particular, ski boots, gloves and other clothing articles. More particularly, it relates to such a drying stand which can be adapted to any conventional, hand-held hair dryer to dry wet clothing items.

Ski clothing and, in particular, ski boots and ski boot inserts or bladders, gloves, hats, goggles, etc. often become wet after use and must be dried prior to their re-use. Typically, the skier will simply place his ski boots and other clothes near a hot-heat source to dry them out, however, this may ruin, for example, the ski boots. There are also a variety of relatively expensive boot dryers having varying degrees of effectiveness. See, for example, U.S. Pat. No. 4,136,464, granted to Hay; U.S. Pat. No. 194,512, to Donaldson; and U.S. Pat. No. 243,313, to Varnado. In addition, a variety of drying fixtures for clothing and other items have been proposed, which employ conventional hair dryers. See, for example, U.S. Pat. No. 2,076,735, to Leindorf; U.S. Pat. No. 4,094,076, to Baslow; U.S. Pat. No. 5,115,580, to Blumenfeld et al.; U.S. Pat. No. 5,014,446, to Reesman. However, these devices are generally disadvantageous for a number of reasons, including the cost of manufacture, complexity of the design and/or because they are unsuitable for ski boot bladders or liners and/or ski gloves. In addition, they generally cannot accommodate a variety of differently dimensioned hair dryer nozzles, and consequently, they are not universally adaptable and effective for a wide range of hand-held hair dryers.

SUMMARY OF THE INVENTION

Accordingly, it is an object of the present invention to provide a novel drying stand for ski boots, gloves and other clothing items and accessories.

It is a more particular object of the present invention to provide such a novel drying stand which is relatively simple in construction, easy to manufacture and relatively inexpensive to produce.

It is yet another object of the present invention to provide such a novel drying stand which can support and accommodate a variety of conventional hand-held, portable hair dryers having differently dimensioned nozzles in a highly effective, simple and safe manner.

It is a more particular object of the present invention to provide such a novel drying stand, having the foregoing attributes and characteristics, which can specifically accommodate ski boots and gloves in a relatively compact and easy-to-assemble drying stand.

Certain of the foregoing and related objects are readily attained in a novel drying stand for ski boots, gloves and other clothing items, embodying the present invention which includes a generally planar, horizontally-disposed top wall having an opening formed therethrough dimensioned to accommodate a portable hair dryer nozzle and means for supporting the top wall in a raised generally horizontal position relative to a ground support so as to enable one to position a clothing article beneath the opening in the top wall. A variable-adjustable aperture means is mounted adjacent the opening through which the nozzle may extend and be generally supported in an upright manner. The aperture means automatically adjusts to the diameter of the dryer nozzle to provide proper support therefor.

Preferably, the aperture means comprises a resilient, generally planar gasket having a generally centrally-disposed multi-slit opening, which gasket is mounted underneath the top wall such that the top wall and gasket openings are generally vertically aligned. The multi-slit opening of the gasket defines a plurality of resilient, radially inwardly-extending fingers which are normally disposed in a closed position in which they lie in the plane of the gasket, but which, in an open position, are biased downwardly, when a hair dryer nozzle is inserted into the multi-slit opening.

Most advantageously, the stand additionally includes a removable rack having a base and a plurality of upstanding pegs mounted thereon. The pegs serve to support the gloves in an upright and inverted fashion.

In one preferred embodiment, the means for supporting comprises a plurality of spaced apart legs. Most desirably, the top wall is rectangular and the drying stand additionally includes a rectangular bottom wall and the means for supporting the top wall interconnects the top wall and the bottom wall. In an alternate embodiment of the invention, the means for supporting comprises at least a pair of spaced apart side walls, which support opposite ends of the top wall and the stand additionally includes a rear wall interconnecting the two side walls.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for the purpose of illustration only and not as a definition of the invention.

In the drawings, wherein similar reference characters denote similar elements throughout the several views.

DETAILED DESCRIPTION OF THE PREFERRED AND ILLUSTRATED EMBODIMENTS

Figure 1:
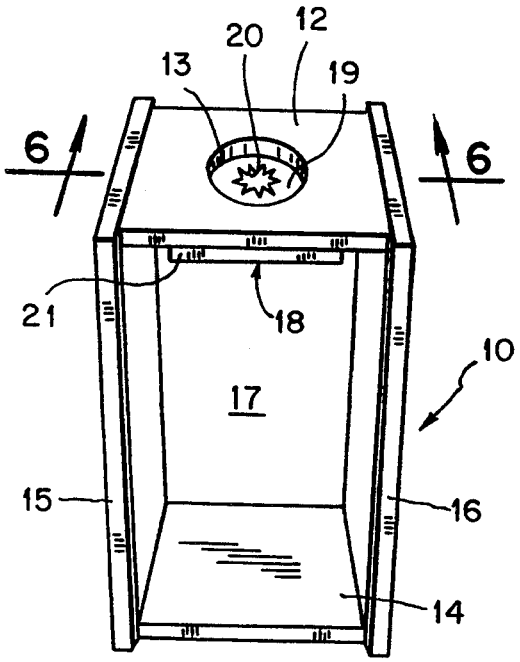
FIG. 1 is a front perspective view of a novel drying stand embodying the present invention.

Turning now in detail to the appended drawings and, in particular, FIG. 1 thereof, therein illustrated is a novel drying stand for ski boots, gloves and the like, embodying the present invention, which includes a generally box-shaped enclosure, generally designated 10, which includes a generally rectangular top wall 12, having a central opening 13 formed therethrough, a bottom wall 14 spaced therebelow, a pair of side walls 15, 16 and a rear wall 17, which support and interconnect said top and bottom walls 12 and 14. A variable-adjustable diaphragm or aperture, generally designated 18, is mounted beneath the top wall.

Figure 5:
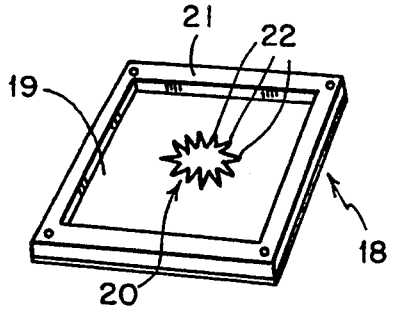
FIG. 5 is a perspective view of the variable-adjustable aperture means of the invention.
Figure 6:
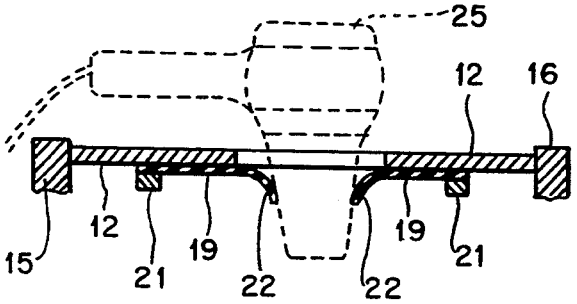
FIG. 6 is a fragmentarily-illustrated, cross-sectional view of the top wall and aperture means mounted therebelow, further showing in phantom line the hair dryer and its nozzle passing through and being supported in an upright manner by the aperture means.

As shown more clearly in FIG. 5, diaphragm 18 consists of a flexible, resilient plastic and/or rubber, generally planar or sheet-like gasket 19 having a multi-slit, generally centrally-disposed opening 20 which, as shown in FIG. 1, is intended to be generally aligned with the opening 13 in top wall 12. The diaphragm 19 is supported by a peripherally-extending, rectangular frame 21. As shown in FIG. 6, frame 21 is mounted on the underside of top wall 12 so that opening 20 is aligned with opening 13, as previously described. The slotted opening 20 of diaphragm 18 defines a plurality of regular or irregular, radially inwardly-directed, resilient fingers 22, which as seen best in FIG. 6, will engage the nozzle 24 of a conventional hand-held hair dryer 25 in a biased manner, so as to support the same in a generally upright position. As shown in FIG. 5, fingers 22 normally lie in the plane of the diaphragm 19, but may be moved to an open position, as shown in FIG. 6, upon insertion of the nozzle 24 of the hair dryer 25. In this position, the fingers 22 circumferentially surround the nozzle 24 in a downwardly deflected position, the fingers 22 being biased against the nozzle, thereby providing appropriate support therefor so that the heated air flow from the nozzle will flow vertically downward.

Figure 2:
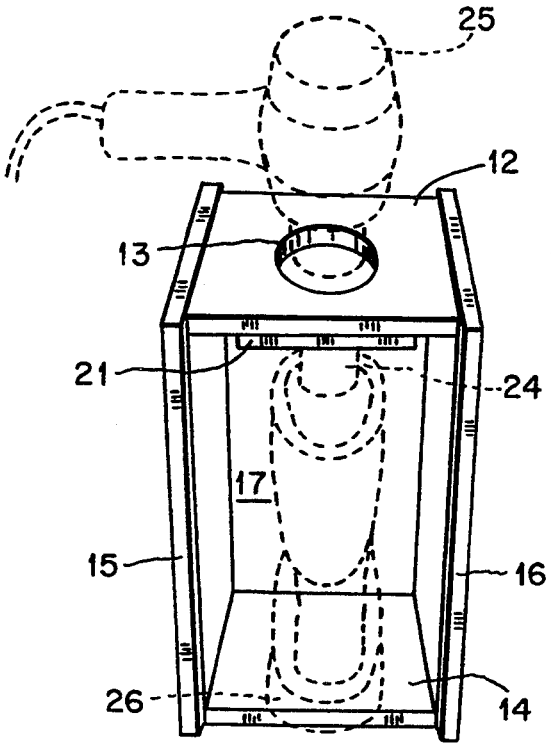
FIG. 2 is a front perspective view similar to that of FIG. 1, but showing in phantom line the provision of a conventional hand-held hair dryer and a ski boot positioned therebelow.
Figure 3:
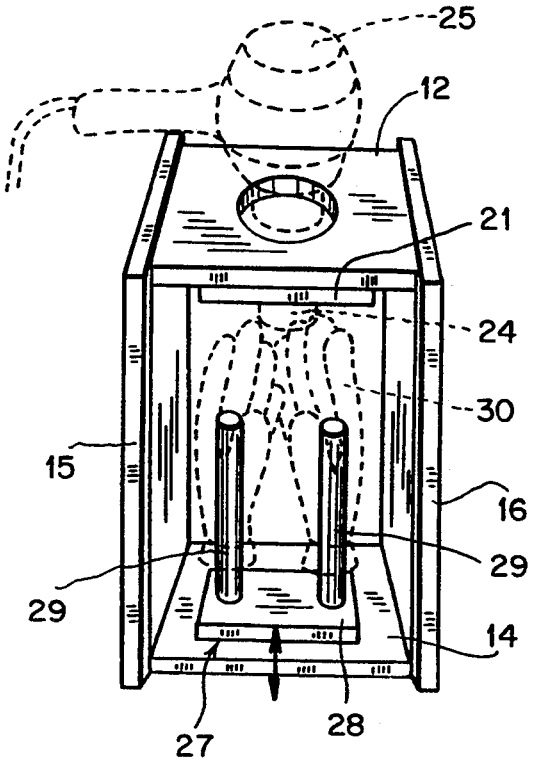
FIG. 3 is a front perspective view similar to that of FIGS. 1 and 2, but showing in phantom line the provision of a hair dryer and ski gloves mounted therebelow in an upright manner on a drying rack.
Figure 4:
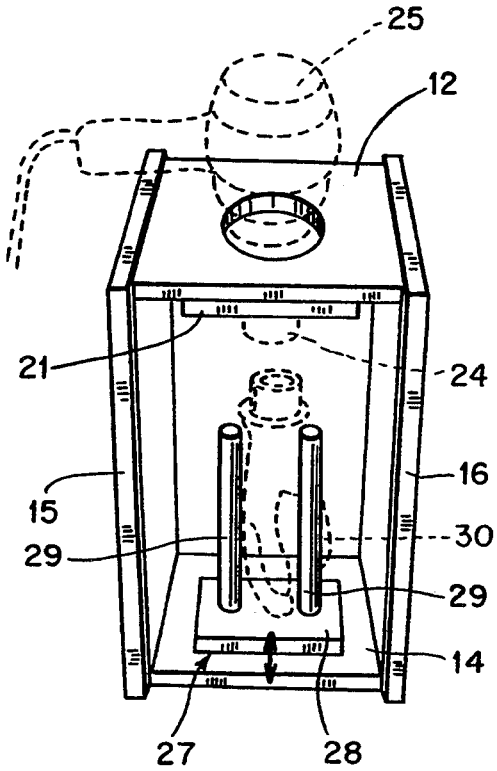
FIG. 4 is a front perspective view similar to that of FIGS. 1–3, but showing in phantom line the provision of a hair dryer and inverted glove therebelow on the drying rack.

As can be seen in FIGS. 2–4, when the hair dryer is so supported, the same is conveniently positioned above a number of articles that need to be dried. For example, as shown in FIG. 2, a ski boot or ski liner 26 may be positioned on the bottom wall 14, directly beneath the nozzle 24 and the top wall opening 13, so that the inside thereof may be exposed to the warm air stream emitted by the hair dryer 25. As shown in FIGS. 3 and 4, the drying stand may be provided with a removable drying rack 27 (see arrow) consisting of a horizontally-disposed platform 28 which, in turn, supports a pair of spaced apart, upright pegs 29. As shown in FIG. 3, a pair of gloves 30 may be inserted on the pegs 29, so as to dry the outside of the gloves 30. Alternatively, as shown in FIG. 4, the glove 30 may be supported in an inverted position between the pegs 29 so that the opening into the interior of the glove is positioned immediately below the hair dryer nozzle 24.

Figure 8:
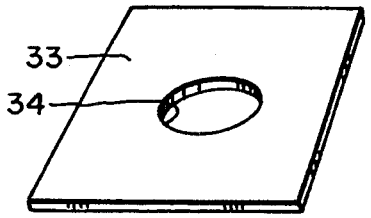
FIG. 8 is a perspective view of the glove support shelf shown in FIG. 7.
Figure 7:
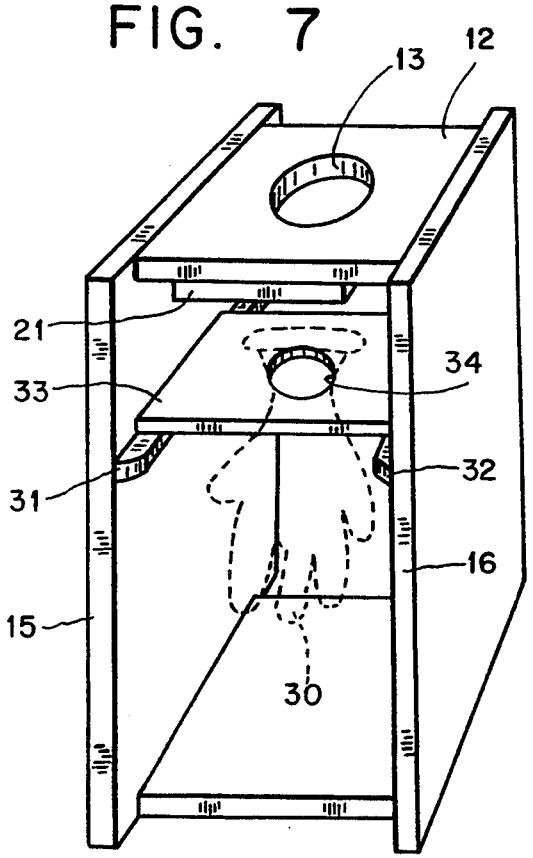
FIG. 7 is a front and side perspective view of the drying stand, further showing the provision of a drying shelf for supporting an inverted glove, the latter of which is shown in phantom line.

Alternatively, a drying shelf 33 may be employed for gloves and the like, as shown in FIG. 7. In this embodiment, the side walls 15 and 16 are provided with inwardly-directed ledges 31, 32, respectively, which, in turn, support a planar, generally rectangular and removable shelf 33. As shown in FIG. 8, shelf 33 has a central opening 34. As shown in FIG. 7, the end of the glove 30 containing the opening to its interior is inserted through the opening 34 of the shelf 33 so that it is positioned beneath the opening 13 in top wall 12, so air from the nozzle 34 (not shown) will be directed into the interior of the glove 30.

Figure 9:
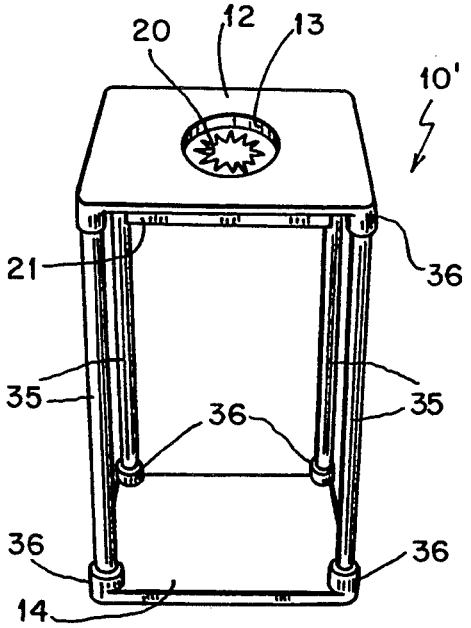
FIG. 9 is a front perspective view of an alternate embodiment of the drying stand shown in FIG. 1.

Finally, FIG. 9 discloses an alternate embodiment of the invention. A stand 10' is provided similar to that of stand 10 except that, instead of two side walls and a rear wall, it consists of four legs 35 disposed at opposite corners of both the top and bottom walls 12, 14, so as to interconnect the same. The legs 35 comprise preferably hollow, cylindrical rods. The top and bottom walls 12, 14 each have four cylindrical collars 36, which receive the ends of the legs 35 in a friction fit manner, so as to allow for easy assembly of the top and bottom walls 12, 14 via the use of the legs 35. The construction of the drying stand 10' is otherwise the same as the previously-described stand 10.

As can be appreciated, the drying stand of the present invention is designed to offer versatility and adaptability to a variety of hand-held, portable hair dryers having differently dimensioned nozzles. The gasket means and its variable-adjustable opening will accommodate a variety of nozzle dimensions. The removable glove rack and/or shelf conveniently slides under the housing top wall to hold gloves in place for any drying time necessary. The drying stand and shelf rack, can be made of either wood, plastic, or metal or a combination thereof. The gasket can also be made from plastic or rubber or possibly cardboard material, such as a cardboard gasket, from which a variety of openings might be cut, in situ to suit a particular drying nozzle. The slit opening and the fingers thereof of the gasket means can, of course, be modified to suit the particular application.

Accordingly, while only a few embodiments of the present invention has been shown and described, it is to be understood that many changes and modifications may be made thereunto without departing from the spirit and scope of the invention as disclosed herein.

What is claimed is:

1. A drying stand for ski boots, gloves and other clothing items comprising:

a generally planar, horizontally-disposed top wall having an opening formed therethrough dimensioned to accommodate a hair blow nozzle;

means for supporting said top wall spaced in a raised position relative to a ground support so as to be able to position a clothing article beneath said opening in said top wall; and variable-adjustable aperture means mounted adjacent said opening through which said nozzle may extend and be generally supported in an upright manner, said aperture means automatically adjusting to the diameter of the nozzle to provide proper support therefor and wherein said aperture means comprises a resilient, generally planar gasket having a generally centrally-disposed multi-slit opening, which gasket is mounted underneath said top wall such that said top wall and gasket openings are generally vertically aligned, said multi-slit opening of said gasket defining a plurality of resilient, radially inwardly-extending fingers which are normally disposed in a closed position in which they lie in the plane of said gasket, but which, in an open position, are biased downwardly, wherein a hair blower nozzle is inserted into said opening.

2. The drying apparatus according to claim 1, wherein said stand additionally includes a removable rack having a base and a plurality of upstanding pegs mounted thereon, which pegs serve to support gloves in an upright and inverted fashion.

3. The drying stand according to claim 1, wherein said means for supporting comprises a plurality of spaced apart legs.

4. The drying stand according to claim 1, wherein said top wall is rectangular and said drying stand additionally includes a rectangular bottom wall and wherein said means for supporting said top wall interconnects said top wall and said bottom wall.

5. The drying stand according to claim 1, wherein said means for supporting comprises at least a pair of spaced apart side walls, which support opposite ends of said top wall.

6. The drying stand according to claim 5, wherein said stand additionally includes a rear wall interconnecting said two side walls.

7. A drying stand for ski boots, gloves and other clothing items comprising:

a generally planar, horizontally-disposed top wall having an opening formed therethrough dimensioned to accommodate a hair blow nozzle;

means for supporting said top wall spaced in a raised position relative to a ground support so as to be able to position a clothing article beneath said opening in said top wall;

variable-adjustable aperture means mounted adjacent said opening through which said nozzle may extend and be generally supported in an upright manner, said aperture means automatically adjusting to the diameter of the nozzle to provide proper support therefor; and a removable rack having a base and a plurality of upstanding pegs mounted thereon, which pegs serve to support gloves in an upright and inverted fashion.

8. The drying stand according to claim 7, wherein said aperture means comprises a resilient, generally planar gasket having a generally centrally-disposed multi-slit opening, which gasket is mounted underneath said top wall such that said top wall and gasket openings are generally vertically aligned, said multi-slit opening of said gasket defining a plurality of resilient, radially inwardly-extending fingers which are normally disposed in a closed position in which they lie in the plane of said gasket, but which, in an open position, are biased downwardly, when a hair dryer nozzle is inserted into said multi-slit opening.

9. The drying stand according to claim 7, wherein said means for supporting comprises a plurality of spaced apart legs.

10. The drying stand according to claim 7, wherein said top wall is rectangular and said drying stand additionally includes a rectangular bottom wall and wherein said means for supporting said top wall interconnects said top wall and said bottom wall.

11. The drying stand according to claim 7, wherein said means for supporting comprises at least a pair of spaced apart side walls, which support opposite ends of said top wall.

12. The drying stand according to claim 11, wherein said stand additionally includes a rear wall interconnecting said two side walls.

* * * * *